US011143130B2

(12) United States Patent
Nishimura

(10) Patent No.: US 11,143,130 B2
(45) Date of Patent: Oct. 12, 2021

(54) INJECTION CONTROLLER

(71) Applicant: DENSO CORPORATION, Kariya (JP)

(72) Inventor: Toshio Nishimura, Kariya (JP)

(73) Assignee: DENSO CORPORATION, Kariya (JP)

( * ) Notice: Subject to any disclaimer, the term of this patent is extended or adjusted under 35 U.S.C. 154(b) by 208 days.

(21) Appl. No.: 16/208,634

(22) Filed: Dec. 4, 2018

(65) Prior Publication Data

US 2019/0170078 A1 Jun. 6, 2019

(30) Foreign Application Priority Data

Dec. 5, 2017 (JP) ..... JP2017-233395

(51) Int. Cl.

| | |
|---|---|
| ***F02D 41/20*** | (2006.01) |
| ***H01F 7/20*** | (2006.01) |
| ***H01F 7/18*** | (2006.01) |
| *F02D 41/30* | (2006.01) |

(52) U.S. Cl.

CPC ..... *F02D 41/20* (2013.01); *H01F 7/1805* (2013.01); *H01F 7/206* (2013.01); *F02D 41/3005* (2013.01); *F02D 2041/2003* (2013.01); *F02D 2041/2024* (2013.01); *F02D 2041/2051* (2013.01); *F02D 2041/2058* (2013.01)

(58) Field of Classification Search

CPC ..... F02D 41/20; H01F 7/1805; H01F 7/206
See application file for complete search history.

(56) References Cited

U.S. PATENT DOCUMENTS

| | | | | |
|---|---|---|---|---|
| 8,776,763 | B2 * | 7/2014 | Omori | F02D 41/221 123/490 |
| 10,087,866 | B2 * | 10/2018 | Tan | F02D 41/345 |
| 10,865,727 | B2 * | 12/2020 | Jahn | F02D 41/2467 |
| 2003/0010325 | A1 | 1/2003 | Reischl et al. | |
| 2005/0284950 | A1 * | 12/2005 | Yamazaki | F02D 41/20 239/5 |
| 2006/0137661 | A1 * | 6/2006 | Hayakawa | F02D 41/20 123/499 |
| 2010/0242920 | A1 * | 9/2010 | Omori | F02D 41/221 123/490 |
| 2012/0194961 | A1 * | 8/2012 | Yamada | F02D 41/20 361/152 |
| 2014/0020661 | A1 * | 1/2014 | Nishimura | F02D 41/3005 123/480 |
| 2014/0034025 | A1 * | 2/2014 | Nishimura | F02M 69/04 123/478 |

(Continued)

FOREIGN PATENT DOCUMENTS

| | | | |
|---|---|---|---|
| JP | 2003-222061 | A | 8/2003 |
| JP | 2015-021428 | A | 2/2015 |

*Primary Examiner* — Rafael O De Leon Domenech
(74) *Attorney, Agent, or Firm* — Posz Law Group, PLC

(57) ABSTRACT

An injection controller has a voltage applicator that applies a voltage to a driving coil of an injection valve. After a voltage is applied to the driving coil with a peak current for opening the injection valve, the voltage applicator applies a power supply voltage to the driving coil in an ON-OFF manner, to supply the driving coil with a less-than-peak current. A comparator detects whether a terminal voltage at a terminal of the coil is less than a predetermined threshold voltage. Upon detecting that the terminal voltage is less than the threshold voltage, a discharge switch applies a boosted voltage to the driving coil.

12 Claims, 9 Drawing Sheets

(56) References Cited

U.S. PATENT DOCUMENTS

| | | | | |
|---|---|---|---|---|
| 2014/0069389 | A1* | 3/2014 | Nishimura | F02D 41/20 123/478 |
| 2014/0069390 | A1* | 3/2014 | Nishimura | F02D 41/20 123/478 |
| 2014/0069391 | A1* | 3/2014 | Nishimura | F02D 41/30 123/478 |
| 2016/0290228 | A1 | 10/2016 | van der Merwe et al. | |
| 2017/0089291 | A1 | 3/2017 | Suzuki | |
| 2017/0089292 | A1* | 3/2017 | Nishida | F02D 41/22 |
| 2018/0023503 | A1* | 1/2018 | Kimura | F02D 41/20 701/104 |
| 2018/0156148 | A1* | 6/2018 | Nishimura | F02D 41/30 |
| 2019/0145330 | A1* | 5/2019 | Satake | F02D 41/04 123/445 |

* cited by examiner

INJECTION CONTROLLER

CROSS REFERENCE TO RELATED APPLICATION

The present application is based on and claims the benefit of priority of Japanese Patent Application No. 2017-233395, filed on Dec. 5, 2017, the disclosure of which is incorporated herein by reference.

TECHNICAL FIELD

The present disclosure generally relates to an injection controller for controlling the opening and closing of an injection valve.

BACKGROUND INFORMATION

An injection controller is a device used for opening and closing an injection valve to inject fuel into a cylinder of a vehicle engine. Typically a vehicle battery may operate at 12 V. When the voltage of an in-vehicle battery falls to a low-voltage level (e.g., when the battery voltage drops to 8 V or as low as 6 V), operating the injection valve may be more difficult. That is, in contrast to a normal, 12V operating condition where the injection valve may be reliably opened and closed, the reliable valve operation and fuel injection in a low-voltage operating condition may be difficult. However, in low voltage supply conditions, a required amount of electric current for keeping the injection valve open may be not supplied to a driving coil when the low voltage is applied to the driving coil. During low voltage supply conditions, injection controllers may encounter problems in supplying enough electric current for driving the coil, and thus, are subject to improvement.

SUMMARY

The present disclosure describes an injection controller that can more reliably control the injection valve in conditions where the voltage applied to the driving coil of the injection valve is at a lower voltage level than normal.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Figure 1:
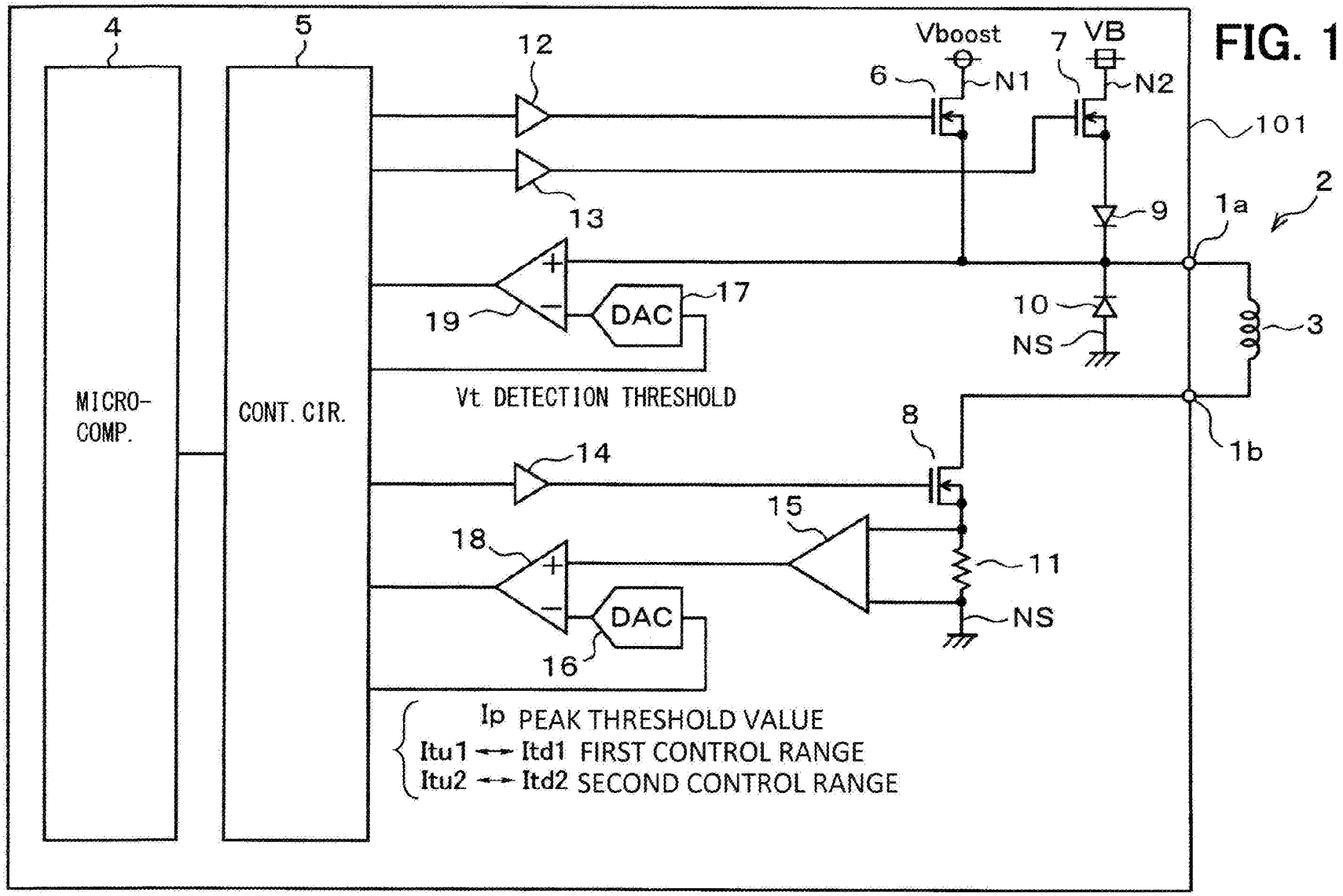
FIG. 1 illustrates a schematic diagram of an injection controller in a first embodiment of the present disclosure.

Hereinafter, the embodiments of the present disclosure will be described with reference to the attached drawings. Like elements and features common to the various embodiments are represented in the drawings by the same reference characters. Throughout the different embodiments, a repeat description of like elements and features already described in detail may be omitted.

First Embodiment

The first embodiment is described with reference to FIGS. 1 and 2. FIG. 1 illustrates a schematic diagram of an electronic control unit (ECU) 101 used as an injection control device, or more simply, an injection controller. More specifically. FIG. 1 shows an example electrical configuration of the electronic control unit (ECU) 101 used as the injection controller. The electronic control unit 101 is a device that may be used for driving N-number of solenoid-type injection valves 2 for injecting and supplying fuel to an engine having N-number of cylinders in a vehicle such as an automobile, where N is greater than or equal to one ($N \geq 1$). More specifically, the electronic control unit 101 may control a power supply to an electromagnetic coil 3 as an inductive load, where the electromagnetic coil 3 is part of the injection valve 2. The injection valve 2 is a normally-closed solenoid valve, which is opened by receiving an electric current through the coil 3. Fuel pressurized by a fuel pump is supplied to the injection valve 2, and the pressurized fuel is supplied from the injection valve 2 to a cylinder of the internal combustion engine when the valve 2 opens. In such manner, the injection valve 2 can provide an air-fuel mixture by injecting fuel to the internal combustion engine. The electronic control unit 101 is configured to control when the power supply to the electromagnetic coil 3 begins (e.g., controls the power supply start time) as well as the duration (e.g., power supply time) of the power supply to the electromagnetic coil 3. The injection valve(s) 2 may be referred to as injector(s) 2. The electromagnetic coil 3 may simply be referred to as a coil 3. The vehicle, vehicle engine, and engine cylinder are not shown in the drawings.

The injection valve 2 may be connected to the electronic control unit 101 via an upstream side terminal 1*a* and a downstream side terminal 1*b*. Upstream may refer to the power supply side of the electronic control unit 101, that is, the portion of the electronic control unit 101 supplying power to the injection valve 2. Downstream may refer to the power return side of the electronic control unit 101, that is, a return path of the power supplied to the injection valve 2.

As shown in FIG. 1, the electronic control unit 101 includes a microcomputer 4, a control circuit 5, a discharge switch 6, a constant current control switch (e.g., a voltage applicator) 7, and a cylinder selection switch 8. The control circuit 5 may also be referred to as a control section and a determiner. The discharge switch 6 may also be referred to as a high-voltage applicator 6 or a voltage booster 6. The constant current control switch 7 may also be referred to as a voltage applicator 7. The electronic control unit 101 starts and stops the power supply to the driving coil 3 of the injection valve 2, thereby opening and closing the injection valve 2. The electronic control unit 101 also includes peripheral circuits and electronic components in addition to the above-described components. The peripheral circuits and components include, for example, a diode 9 for preventing reverse current flow, a freewheeling/flyback diode 10, a current detection resistor 11 as a current detecting section, voltage buffers 12, 13, and 14, an amplifier 15 for detecting a voltage generated in the resistor 11, D/A converters 16 and 17, and comparators 18 and 19. The current detection resistor 11, in addition to being referred to as a current detecting section, may also be referred to as a current detector. Because the comparator 19 may compare different voltages to make a low-voltage determination, as described below in greater detail, the comparator 19 may also be referred to as a low-voltage detector 19.

The microcomputer 4 includes, for example, a CPU, a memory such as an EEPROM and an SRAM, and input/output (I/O) circuitry (all not shown). The memory is a non-transitory, substantive storage medium. The microcomputer 4 operates by executing a program stored in the non-transitory, substantive storage medium, and, as a result of executing the program, the microcomputer 4 outputs an injection instruction signal to the control circuit 5 at an injection instruction timing (e.g., to begin a fuel injection operation). The circuit elements of the control circuit 5, the amplifier 15, the D/A converters 16 and 17, and the comparators 18 and 19 may be implemented as one or more integrated circuit devices such as an Application Specific Integrated Circuit (ASIC). The integrated circuit devices may respectively perform the controls associated with each of the circuit elements by using its hardware and software. The software control may be based on a combination of a processing device (e.g., a CPU or like processor) and a storage device (e.g., a RAM, a ROM, and an EEPROM). That is, the CPU may execute a program or instruction set stored in the storage device (e.g., non-transitory, substantive storage medium) for performing a process/function associated with the circuit element.

The control circuit 5 controls the discharge switch 6 to turn ON and OFF via the voltage buffer 12. The control circuit 5 also controls the constant current switch 7 to turn ON and OFF via the voltage buffer 13. The control circuit 5 also controls the cylinder selection switch 8 to turn ON and OFF via the voltage buffer 14. The control circuit 5 detects the current flowing through the current detection resistor 11 based on an inter-terminal voltage of the current detection resistor 11, and performs various controls according to the detection signal of the detected current. The control circuit 5 is configured as a control unit that sequentially performs a pick-up current control and a hold current control that are both described below in greater detail. Each of the discharge switch 6, the constant current switch 7, and the cylinder selection switch 8 may be, for example, an n-channel type metal oxide semiconductor (MOS) transistor with source, gate, and drain terminals. However, these switches 6 to 8 may also be other types of transistors and switching elements, such as bipolar junction transistors and like switching elements.

The discharge switch 6 configured as an n-type MOS transistor has its gate connected to the control circuit 5, its drain connected to a supply node N1 of a boosted voltage Vboost, and its source connected to the terminal 1*a* on an upstream side of the electronic control unit 101, as shown in FIG. 1. The discharge switch 6 is a high-voltage applicator that applies the boosted voltage Vboost to the coil 3 as a second voltage.

The constant current switch 7 is connected at a position between the supply node N2 that supplies a power supply voltage VB and the terminal 1*a* on the upstream side of the electronic control unit 101. More specifically, the constant current switch 7 configured as an n-type MOS transistor has its drain connected to the supply node N2, its gate connected to the control circuit 5 via the voltage buffer 13, and its source connected to the terminal 1*a*, as shown in FIG. 1. The diode 9 for blocking the reverse current flow is connected at a position between the constant current switch 7 and the upstream side terminal 1*a*. A freewheeling/flyback diode 10 is connected in the reverse direction at a position between the upstream side terminal 1*a* and a ground node NS. The constant current switch 7 is a voltage applicator for controlling the application of the power supply voltage VB to the coil 3. That is, the constant current switch 7 turns the power supply voltage VB ON and OFF to control the application of the power supply voltage VB to the coil 3 and supply the coil 3 with electric current at a level lower than the peak current Ip, for example, during the pick-up current control and the hold current control.

The coil 3 of the injection valve 2 is connected at a position between the terminal 1*a* on the upstream side of the electronic control unit 101 and the terminal 1*b* on a downstream side. The n-type MOS transistor serving as the cylinder selection switch 8 is connected at a position in series between the terminal 1*b* on the downstream side and the ground node NS. More specifically, the drain of the cylinder selection switch is connected to the terminal 1*b* and the source of the cylinder selection switch is connected to the ground node NS via the current detection resistor 11, as shown in FIG. 1. The gate of the cylinder selection switch 8 is connected to the control circuit 5 via the voltage buffer 14.

The inter-terminal voltage of the current detection resistor 11 is input to the amplifier 15. The amplifier 15 amplifies the inter-terminal voltage of the current detection resistor 11 and outputs it to the non-inverted input terminal of the comparator 18. The control circuit 5 supplies a voltage that corresponds to a current detection threshold value to the inverted input terminal of the comparator 18 through the D/A converter 16. The control circuit 5 controls the voltage value to the comparator 18 by switching the voltage to the comparator ON and OFF using, for example, a pulse-width modulation (PWM) switching technique. The current detection threshold value may be, for example, a peak current threshold value Ip, an upper limit value Itu1 and lower limit value Itd1 of a first control range, and an upper limit value Itu2 and a lower limit value Itd2 of a second control range. The comparator 18 may normally output a low level output signal "L," but may change its output to a high level output signal "H," for example, depending on the voltage that is input to the comparator 18.

With regard to the comparator 19, the voltage of the terminal 1*a* on the upstream side is input to the non-inverted input terminal of the comparator 19. The control circuit 5 inputs a predetermined voltage detection threshold value Vt to the inverted input terminal of the comparator 19 through the D/A converter 17, and the detection result of the comparator 19 is input to the control circuit 5. In such manner, the comparator 19 functions as a low-voltage detector for detecting whether the voltage V1*a* of the upstream terminal 1*a* is lower than the predetermined threshold voltage Vt. As a result, the control circuit 5 can detect whether the voltage V1*a* of the upstream terminal 1*a* is lower than the voltage detection threshold value Vt. In the present embodiment, the voltage Via may also be referred to as the "voltage corresponding to the application voltage to the coil 3".

The characteristic operations of the above-described configuration are described with reference to FIG. 2. FIG. 2 shows a timing chart with the signal changes of various components during an open period of the injection valve.

When a power switch is turned ON based on a vehicle ignition switch (not shown) being turned to an ON position, a power supply voltage VB (e.g., a first voltage) from a vehicle battery is supplied to the microcomputer 4 and the control circuit 5 of the electronic control unit 101. Then, a boost circuit (not shown) boosts the power supply voltage VB to generate the boosted voltage Vboost (e.g., a second voltage) and outputs it to the supply node N1. At this time, the boosted voltage Vboost is higher than the power supply voltage VB.

When the current flowing through the current detection resistor 11 reaches the peak current threshold value Ip, the control circuit 5 digitally instructs the D/A converter 16 to output a voltage corresponding to the peak current threshold value Ip to the inverted input terminal of the comparator 18. As a result, the comparator 18 changes its normal output from "L" to "H" when the comparator 18 receives the voltage corresponding to the peak current threshold value Ip.

Figure 2:
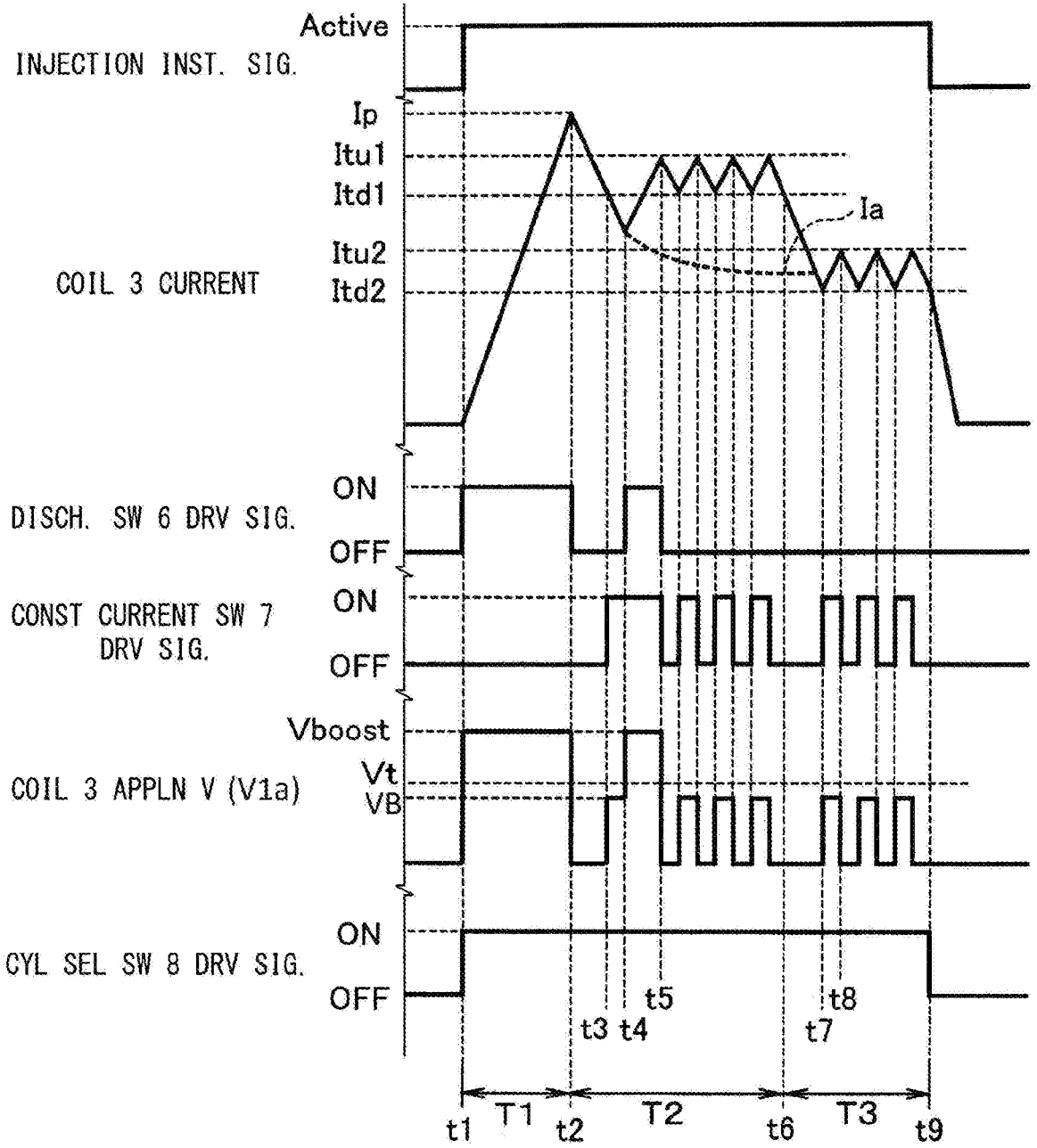
FIG. 2 is a time chart of signals, voltages, and currents in the first embodiment.

When injecting fuel to a certain cylinder, the microcomputer 4 outputs an active level (e.g., "H") of the injection instruction signal to the control circuit 5, and the control circuit 5 controls the cylinder selection switch 8 to turn ON at time t1 in FIG. 2. At the same time, or immediately after time t1, the control circuit 5 turns the discharge switch 6 ON.

As shown in FIG. 2, the period T1 between times t1 and t2 may be a peak current control period. In other words, the peak current control period T1 may be a duration of time between times t1 and t2 where the electronic control unit 101 controls the peak current.

When both of the cylinder selection switch 8 and the discharge switch 6 are turned ON, the boosted voltage Vboost is discharged to the coil 3 during period T1, and the current in the coil 3 can be increased to start an opening operation of the injection valve 2. Since the amplifier 15 detects the voltage between the terminals of the current detection resistor 11, the amplifier 15 can also detect the current flowing through the coil 3.

When the comparator 18 detects that the current of the coil 3 has reached the peak current threshold value Ip at time t2 in FIG. 2, the comparator 18 outputs changes its output from "L" to "H," and outputs a high level "H" signal to the control circuit 5. The control circuit 5, upon receiving the "H" signal and detecting a level change from the comparator 18, transitions to a pick-up current control shown for the period T2 shown in FIG. 2. The period T2 is a duration of time that runs from time t2 to time t6.

When the energy supplied to the driving coil 3 of the injection valve 2 reaches a predetermined amount for opening the valve, the injection valve 2 is fully opened (is put in a full-open state). The energy required for opening the injection valve 2 is determined based on the time integral value of the current in the coil 3, as shown in FIG. 2, that is, the value obtained as a time-integration amount of electric current flowing through the coil 3 of the injection valve 2.

In instances where the peak current control period T1 is shorter or is shortened due to factors such as the type of the injection valve 2, the energy during a shortened peak current control period T1 may not reach a required amount of energy for driving the coil 3 and thus may not be able to provide a required amount energy to fully open the injection valve 2. In such case, the opening operation of the injection valve 2 may not be reliably performed.

The pick-up current control is thus provided to compensate the required energy amount for fully opening the injection valve 2. When the control circuit 5 performs the pick-up current control for the electric current flowing in the coil 3, the control circuit 5 can adjust the current in the coil 3 to increase the current and bring the current within the first current control range Itu1-Itd1. The first current control range Itu1-Itd1 includes pick-up current values that are close to the peak current threshold value Ip and may be used to reliably open the injection valve 2.

The operation during the pick-up current control period T2 is described in detail with reference to FIG. 2. When the control circuit 5 detects that the peak current threshold value Ip has been reached at time t2, the control circuit 5 turns the discharge switch 6 OFF. The control circuit 5 then outputs a digital instruction to the D/A converter 16 for outputting a voltage corresponding to the lower limit value Itd1 of the first current control range to the inverted input terminal of the comparator 18. Using the input on the non-inverting terminal of the comparator 18, the comparator 18 can determine whether the current flowing through the current detection resistor 11 has reached the lower limit value Itd1 of the first current control range.

On the other hand, when the control circuit 5 turns the discharge switch 6 OFF at time t2, an induced voltage is generated across the coil 3 of the injection valve 2 between the terminals 1*a* and 1*b*. At such time, although a current based on the induced voltage flows through the freewheeling/flyback diode 10 to the coil 3, the current flowing through the coil 3 decreases, as shown in FIG. 2, during the period from time t2 to time t4. That is, the current in the coil 3 begins to decrease at t2, and continues to decrease through time t3 to time t4. When the current of the coil 3 reaches the lower limit value Itd1 of the first current control range at time t3, the comparator 18 changes its output to the control circuit 5 from a high level signal "H" to a low level signal "L."

Upon receiving the low level output signal "L" from the comparator 18, that is, when the control circuit 5 detects the change in the signal level from the comparator 18 from "H" to "L," the control circuit 5 turns the constant current switch 7 ON. However, in such instances where the power supply voltage VB drops to a low voltage level (e.g., drops from 12 V to 6 V), even if the control circuit 5 turns the constant current switch 7 ON when the current of the coil 3 reaches the lower limit value Itd1 of the first current control range and applies the power supply voltage VB to the coil 3 so as to increase the current of the coil 3 again, it may not be possible to supply enough current for driving the coil 3 to open the injection valve 2. In such a case, the current of the coil 3 continues to decrease. For example, when no further control is performed (i.e., if the situation is left unattended), the current of the coil 3 may decrease according to a predetermined time constant as shown by the dashed line labeled current Ia in FIG. 2.

As such, the following control process is performed to remedy decreasing current levels in the coil 3.

Even if the control circuit 5 turns the constant current switch 7 ON again at time t3 in FIG. 2 to increase the current of the coil 3 when the voltage Via at the terminal 1*a* is lower than the threshold voltage Vt, the comparator 19 may continue to output a low level signal "L" to the control circuit 5 at time t4 immediately after time t3. Even if the constant current switch 7 is turned ON, the control circuit 5 turns the discharge switch 6 ON at time t4 if the output of the comparator 19 is a low level signal "L".

The control circuit 5 outputs a digital instruction to the D/A converter 16 for outputting a voltage corresponding to the upper limit value Itu1 of the first current control range to the inverted input terminal of the comparator 18. Using the input at the non-inverting terminal of the comparator 18, the comparator 18 can determine whether the current flowing through the current detection resistor 11 has reached the upper limit value Itu1 of the first current control range. Since the boosted voltage Vboost is higher than the power supply voltage VB, the current of the coil 3 increases when the boosted voltage Vboost is supplied to the coil 3. When the current of the coil 3 increases, it rises to the upper limit value Itu1 of the first current control range. The first current control range may also be referred to as the pick-up current control range.

When the current of the coil 3, i.e., the "coil 3 current," reaches the first upper limit value Itu1 of the first current control range, the comparator 18 detects at time t5 that the coil 3 current has reached the first upper limit value Itu1 and the comparator 18 changes its output to the control circuit 5 from a low level signal "L" to a high level signal "H." Upon receiving the high level output signal "H" from the comparator 18, that is, when the control circuit 5 detects the change in the signal level from the comparator 18 from "L" to "H," the control circuit 5 turns both the discharge switch 6 and the constant current switch 7 OFF, thereby stopping the application of the boosted voltage Vboost, as shown at time t5 in FIG. 2.

The control circuit 5 then outputs a digital instruction to the D/A converter 16 for outputting a voltage corresponding to the first lower limit value Itd1 in the first current control range to the inverted input terminal of the comparator 18. When the discharge switch 6 and the constant current switch 7 are turned OFF, the current of the coil 3 decreases. When the coil 3 current reaches the first lower limit value Itd1 in the first current control range, the control circuit 5 turns the constant current switch 7 ON again. The control circuit 5 performs repeated ON/OFF control of the constant current switch 7 so that the current of the coil 3, as detected by the current detection resistor 11, stays within the first current control range Itu 1-Itd 1, as shown from time t5 to time t6 in FIG. 2.

After the pick-up current control period T2 from time t2 to time t6 in FIG. 2 lapses, the control circuit 5 terminates the pick-up current control and performs the hold current control. The hold current control is performed to maintain the open state of the injection valve 2 that was initially opened by the control circuit 5 by performing the peak current control and the pick-up current control.

During the hold current control, the control circuit 5 repeatedly switches the constant current switch 7 ON/OFF so as to hold the current of the coil 3 in the second current control range between the upper limit value Itu2 and the lower limit value Itd2. The upper limit value Itu2 of the second current control range is a value set to be lower than the upper limit value Itu1 of the first current control range, and the lower limit value Itd2 of the second current control range is a value set to be lower than the lower limit value Itd1 of the first current control range. In the present embodiment, the lower limit value Itd1 of the first current control range may be set to be lower than the upper limit value Itu2 of the second current control range. However, this relation of the lower limit value Itd1 relative to the upper limit value Itu2 is an example, and the lower limit value Itd1 is not limited to such relation. For example, as shown in FIG. 2, the current values in the pick-up current control range Itu1-Itd1 do not overlap with the current values in the hold current control range Itu2 to Itd2, but the present disclosure also contemplates overlapping ranges.

Upon starting the hold current control, the control circuit 5 outputs a digital instruction to the D/A converter 16 for outputting a voltage corresponding to the lower limit value Itd2 of the second current control range to the inverted input terminal of the comparator 18. When the control circuit 5 starts the hold current control, the current of the coil 3 decreases. At this time, when the current of the coil 3 reaches the lower limit Itd2 of the second current control range, the comparator 18 detects the change from the high level "H" to the low level "L," and outputs a low level signal "L" to the control circuit 5.

When the control circuit 5 receives the low level signal "L" from the comparator 18, the control circuit 5 turns the constant current switch 7 ON. At the same time, the control circuit 5 outputs a digital instruction to the D/A converter 16 for outputting a voltage corresponding to the upper limit value Itu2 of the second current control range to the inverted input terminal of the comparator 18. When the constant current switch 7 is turned ON, the current of the coil 3 rises. At time t8 in FIG. 2, when the current of the coil 3 reaches the second upper limit value Itu2 of the second current control range, the control circuit 5 turns the constant current switch 7 OFF again. The control circuit 5 then outputs a digital instruction to the D/A converter 16 for outputting a voltage corresponding to the second lower limit value Itd2 of the second current control range to the inverted input terminal of the comparator 18. When the constant current switch 7 is turned ON, the current of the coil 3 may decrease. By repeating the ON/OFF switching process, the current of the coil 3 can be maintained within the second current control range.

When the microcomputer 4 detects that the injection time has lapsed, the microcomputer 4 outputs a non-active, or lower level (e.g., "L") injection instruction signal to the control circuit 5, the control circuit 5 turns the cylinder selection switch 8 OFF. At this time, the control circuit 5 simultaneously turns OFF the constant current switch 7. In such manner, the injection valve 2 is closed, and the injection control for a certain cylinder is stopped.

The features of the present embodiment may be conceptually summarized as follows.

In the present embodiment, after the peak current threshold value Ip is applied to the coil 3, the control circuit 5 controls the application of the power supply voltage VB in an ON/OFF manner to the coil 3 for performing a constant current control within the first current control range that is lower than the peak current threshold value Ip. The control circuit 5 then detects whether the voltage V1*a* corresponding to the voltage Vboost being applied to the coil 3 is lower than the predetermined threshold voltage Vt, and applies the boosted voltage Vboost to the coil 3 when the control circuit 5 detects that the voltage V1*a* is lower than the threshold voltage Vt. In such manner, even when the power supply voltage VB drops to a low voltage level (e.g., when the power supply voltage VB decreases to 8 V or drops to 6 V), by applying the boosted voltage Vboost to the coil 3, the constant current control is able to be performed within the range of the first current control (e.g., Itu1-Itd1), and the injection valve 2 can be reliably and fully opened.

In the present embodiment, an injection valve 2 is opened for a duration of time from time t1 to time t9. The control circuit 5 performs the pick-up current control to perform a constant current control in the first current control range between the upper limit value Itu1 and the lower limit value Itd1 (e.g., from time t5 to time t6 in FIG. 2), and then performs the hold current control for a constant current control in the second current control range between the upper limit value Itu2 and the lower limit value Itd2 (e.g., from time t7 to time t9 in FIG. 2). In this embodiment, the second current control range has lower current levels than the first current control range. Whenever the control circuit 5 detects that the voltage Via of the terminal 1*a* is lower than the predetermined threshold voltage Vt, the control circuit 5 applies the boosted voltage Vboost to the coil 3. In such manner, the injection valve 2 can be reliably and fully opened.

In the example shown in FIG. 2 described above, after the current of the coil 3 has decreased from the peak current threshold value Ip, the boosted voltage Vboost is applied only once when the voltage of the terminal 1*a* has dropped below the threshold voltage Vt. That is, as shown in FIG. 2, the voltage boost is performed only one time after the terminal 1*a* voltage initially drops bellows the threshold voltage Vt. Since the application of the boosted voltage Vboost is performed only once during each injection process, the capacitor (not shown) using stored energy to boost the voltage need not be charged as frequently, thereby reducing power consumption. Here, each injection process may mean each time the injection valve 2 is opened. That is, the boosted voltage Vboost may be applied only once each time the injection valve 2 is opened.

However, the present disclosure is not limited to the above described one-time use of the boosted voltage Vboost. That is, in the pick-up current control period T2, during which the pick-up current control is continued from time t2 to time t6 in FIG. 2, the control circuit 5 may apply the boosted voltage Vboost multiple times when the voltage at terminal 1*a* drops below the threshold voltage Vt. The application of the boosted voltage Vboost may be limited to a predefined number of applications during the injection process. In other words, the application of the boosted voltage Vboost may be limited to a predefined number of times it may be applied each time the injection valve 2 is opened. By using the boosted voltage Vboost to raise the voltage at the terminal 1*a* above the threshold voltage Vt, the pick-up current control can be performed to maintain the current to be within the first current control range (e.g., Itu1-Itd1).

As described above, although the present embodiment contemplates multiple applications of the boosted voltage Vboost, by applying the boosted voltage Vboost only in instances where the current of the coil 3 does not rise (e.g., at time t4 in FIG. 2), the electric charge accumulated in the capacitor for holding the boosted voltage Vboost can be saved. In other words, the size of the capacitor used for the boosted voltage Vboost may be reduced, and the boosting capacity of the boosting circuit that generates the boosted voltage Vboost need not be increased more than what is required.

Second Embodiment

Figure 3:
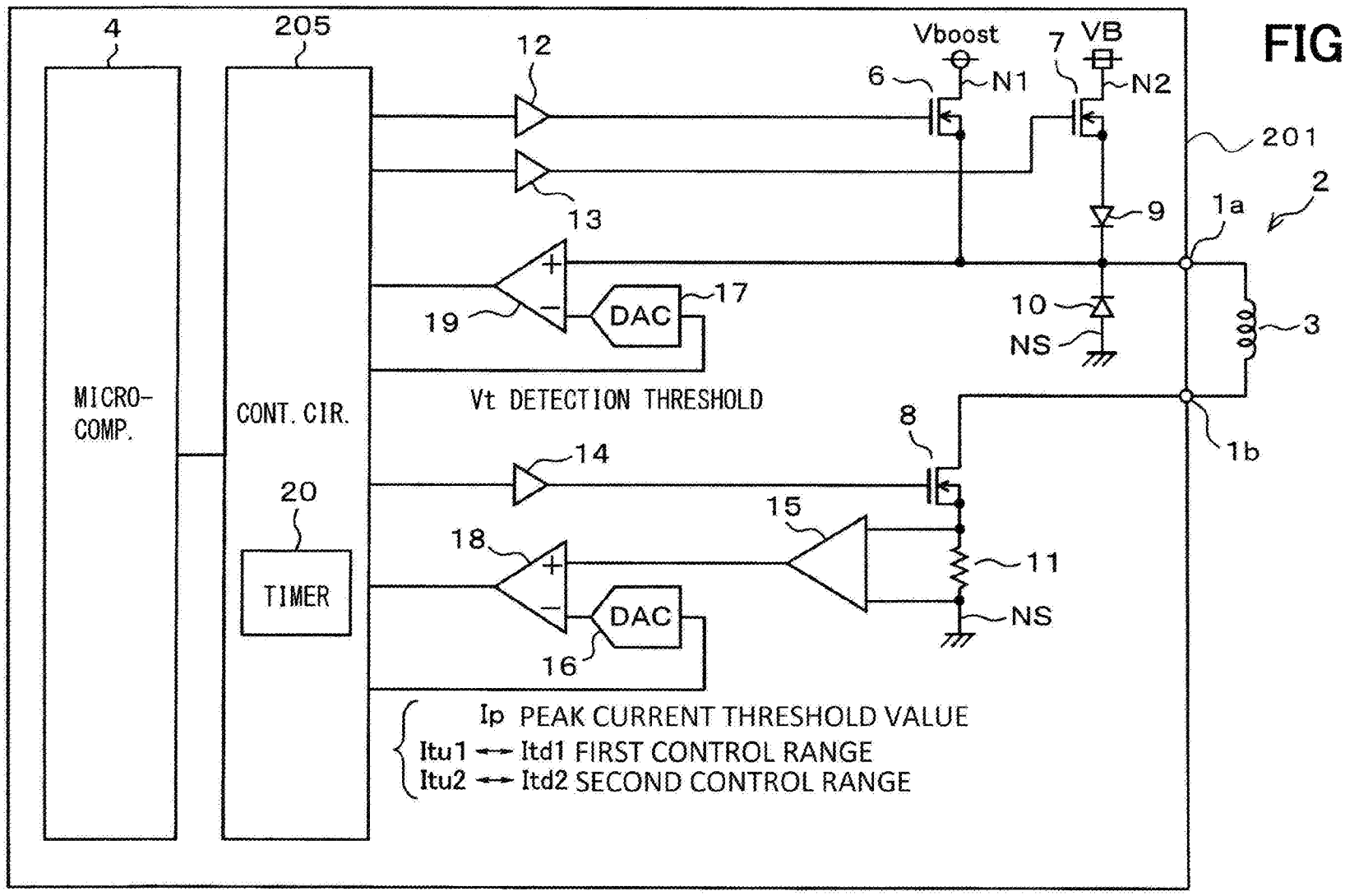
FIG. 3 illustrates a schematic diagram of an injection controller in a second embodiment of the present disclosure.
Figure 4:
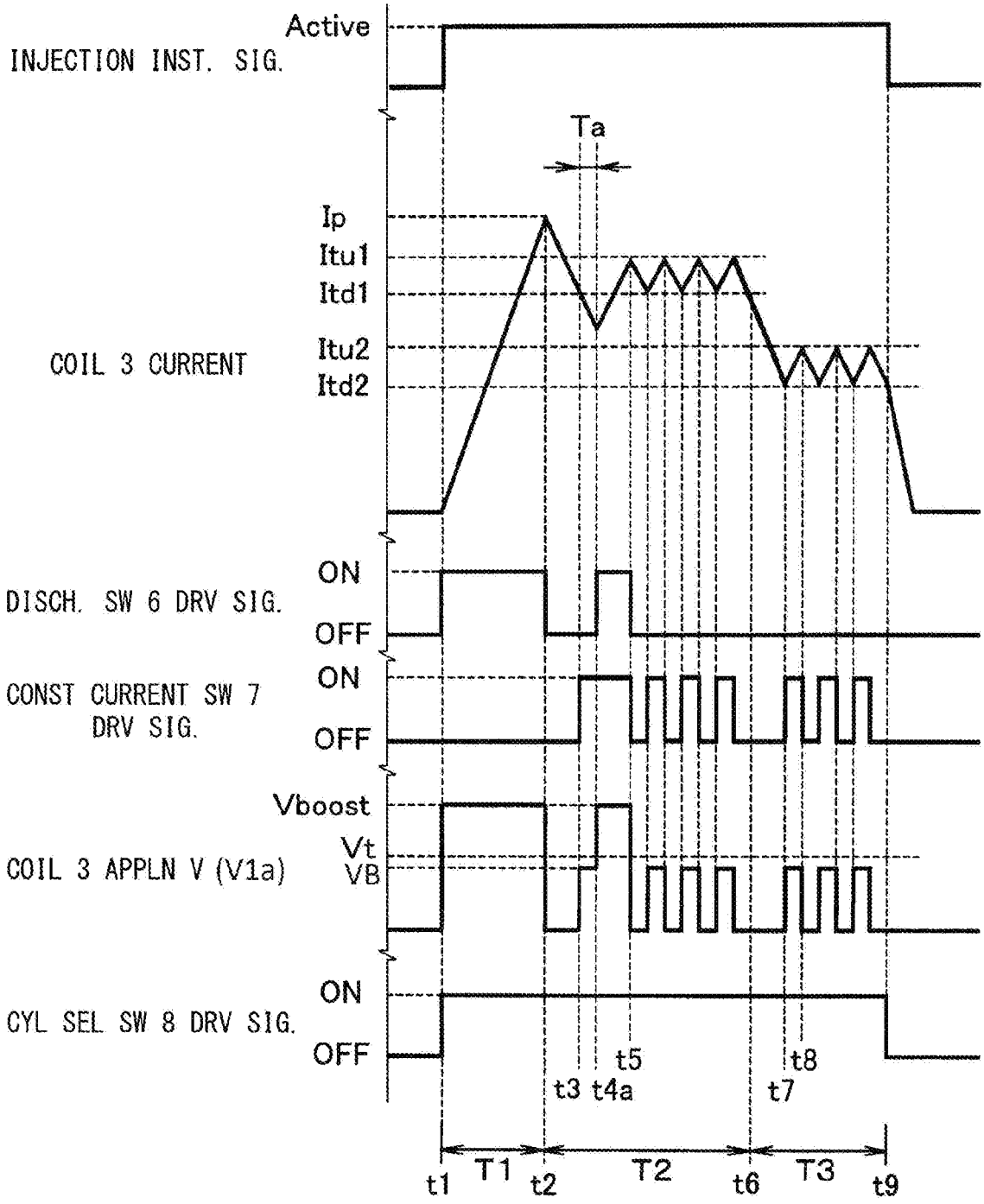
FIG. 4 is a time chart of signals, voltages, and currents in the second embodiment.

FIGS. 3 and 4 illustrate a second embodiment of the present disclosure. As shown in the electrical configuration of FIG. 3, an electronic control unit 201 includes a control circuit 205 having a timer 20. The control circuit 205 may be referred to as a control section 205 or a determiner 205. The timer 20 may be used to measure a predetermined duration of time Ta after the voltage V1*a* at the terminal 1*a* drops below the predetermined threshold voltage Vt. The predetermined time Ta, which may also be referred to as a first predetermined time Ta, is set, for example, based on worst-case conditions where the power supply voltage VB drops to a lowest operating voltage level (e.g., 6 V). Assuming the above-described worst-case, low voltage level condition, the predetermined time Ta is set to be equal to or longer than the time required for the coil 3 current to rise from the first lower limit value Itd1 to the first upper limit Itu1. Otherwise, the electronic control unit 201 may be configured the same as the electronic control unit 101, and a repeat description of the like elements and their functions is omitted.

FIG. 4 shows a timing chart schematic, that is, time points, durations, and signal, voltage, and current changes of the control circuit 205 during the opening period of an injection valve 2. The control method of the control circuit 205 detecting the current of the coil 3 reaching the peak current threshold value Ip is the same as the first embodiment, and a repeat description is omitted. When the control circuit 205 detects that the current of the coil 3 has reached the peak current threshold value Ip at time t2 in FIG. 4, the control circuit 205 turns the discharge switch 6 OFF and the current of the coil 3 begins to decrease. When the current of the coil 3 falls below the lower limit Itd1 of the first current control range at time t3, the comparator 18 changes it output from a high level signal "H" to a low level signal "L." When the control circuit 205 receives the receives the low level signal "L," the control circuit 205 turns the constant current switch 7 ON. That is, when the control circuit 205 detects an "H" to "L" change from the comparator 18, the control circuit 205 turns the constant current switch 7 ON. However, when the power supply voltage VB is a low voltage, even if the power supply voltage VB is applied, the voltage of the coil 3 may not be sufficiently high enough to produce a desired current flow in the coil 3. That is, the voltage VB may not be high enough to produce the desired amount of current in the coil 3.

When the voltage of the coil 3 is not sufficiently high, the comparator 19 connected to the terminal 1*a* outputs a low level signal "L." The control circuit 205 receives the output "L" from the comparator 19 and detects that the voltage Via of the terminal 1*a* has dropped below a predetermined threshold value Vt. The control circuit 205 uses the timer 20 to measure the predetermined amount of time Ta starting from the detection time t3. If the voltage V1*a* of the terminal 1*a* is at a voltage level lower than the predetermined threshold voltage Vt for the duration of time Ta, the control circuit 205 concludes that the voltage Via has dropped below the threshold voltage Vt, and, at time t4 when the predetermined amount of time Ta lapses, the control circuit 205 turns the discharge switch 6 ON to apply the boosted voltage Vboost to the coil 3.

The control circuit 205 functions as a determiner. In such manner, the current of the coil 3 can be increased to be within the first current control range. After the voltage boost is performed and the current of the coil 3 reaches the first current control range Itu1-Itd1, the subsequent control methods and processes are the same as those following the voltage boost in the first embodiment, and a repeat description is omitted.

In the present embodiment, when (i) the application voltage drops below the threshold voltage Vt, and (ii) remains below the threshold voltage Vt at least for the duration of the first predetermined amount of time Ta, the control circuit 205 determines that the voltage of the coil 3 is below the threshold voltage Vt and applies the boost voltage Vboost to the coil 3. In other words, the control circuit 205 applies the boosted voltage Vboost based on (i) one condition that the voltage Via is detected at a voltage level lower than the threshold voltage Vt, and based on (ii) another condition that the voltage Via has remained below the threshold voltage Vt for the first predetermined amount of time Ta. The second embodiment can achieve the same effects as those achieved by the first embodiment.

First Modification of the Second Embodiment

Figure 5:
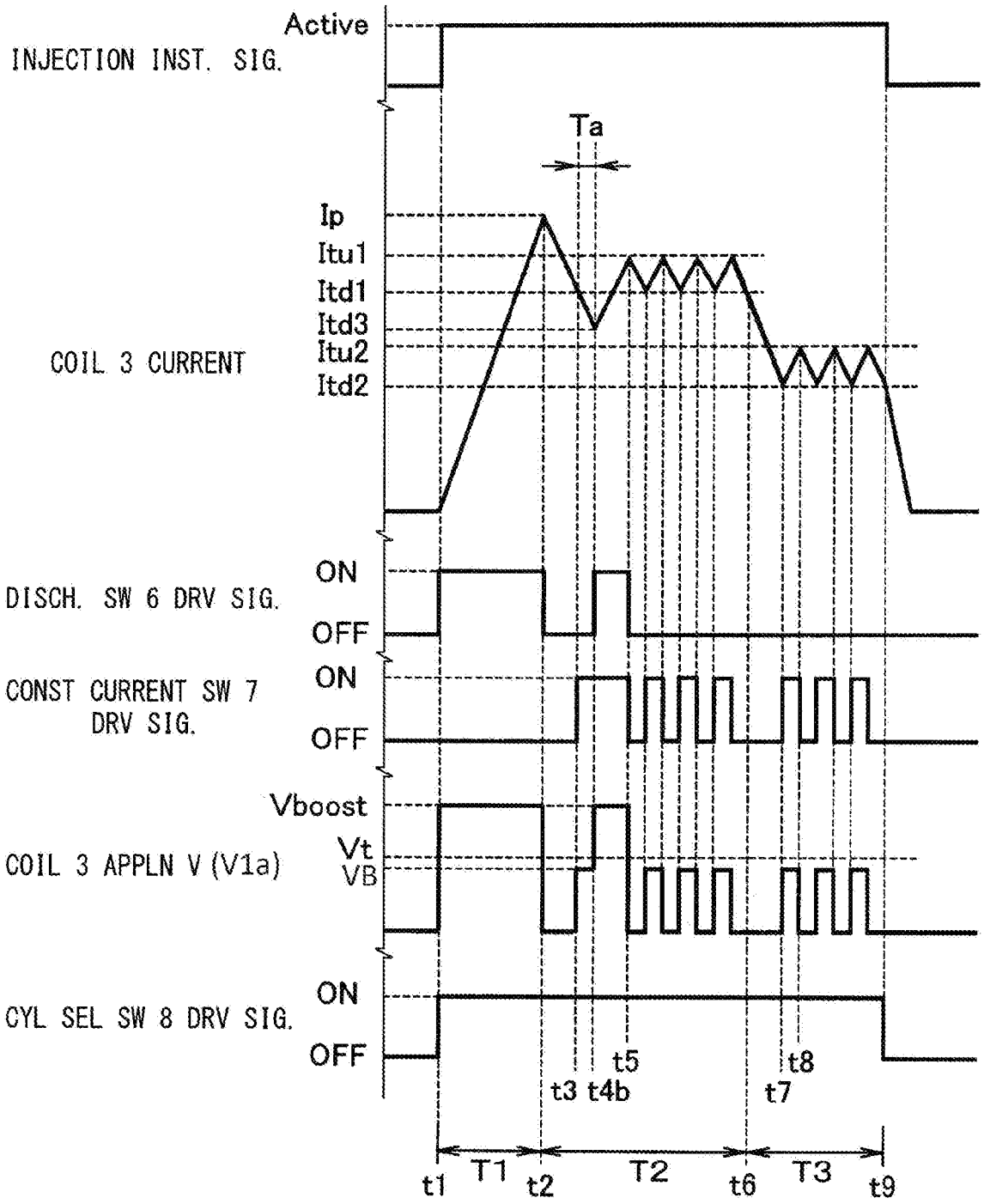
FIG. 5 is a time chart of signals, voltages, and currents in a modification of the second embodiment.

FIG. 5 illustrates a first modification of the second embodiment. In the first modification of the second embodiment, in addition to the condition where the voltage V1*a* remains below the threshold voltage Vt for a first predetermined duration of time Ta, another condition for determining whether to apply the boosted voltage Vboost by turning the discharge switch 6 ON may be whether the current flowing through the coil 3 is equal to or lower than a predetermined third lower limit value Itd3. The control circuit 205 (i.e., the determiner 205) may be used to detect whether the current flowing through the coil 3 is equal to or lower than a predetermined third lower limit value Itd3.

That is, the control circuit 205 may use two or more conditions to determine whether to apply the boosted voltage Vboost. For example, upon determining the satisfaction of two conditions, that is, (i) that the voltage V1*a* of the terminal 1*a* is lower than the threshold voltage Vt, and (ii) that the current flowing through the coil 3 is equal to or lower than the predetermined third lower limit value Itd3, the control circuit 205 may send instructions to the discharge switch 6 at time t4*b* in FIG. 5 to turn ON and apply the boosted voltage Vboost. In other words, the control circuit 205 applies the boosted voltage Vboost to the coil 3 based on the satisfaction of two conditions. The use of multiple conditions to determine whether to apply the boosted voltage Vboost may provide a more reliable control process. The first modification of the second embodiment can achieve the same effects as the second embodiment, but with a more reliable control process.

Second Modification of the Second Embodiment

Figure 6:
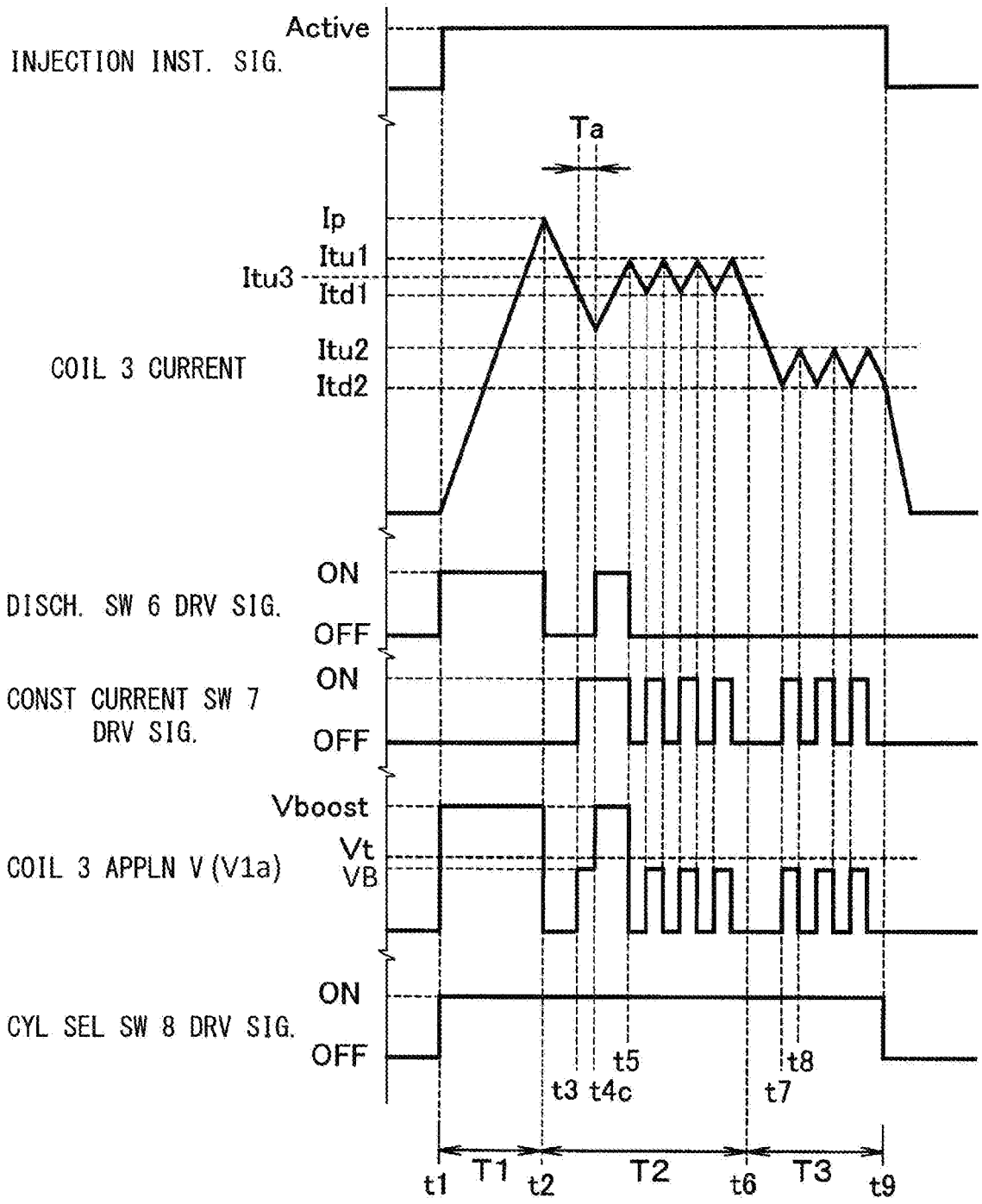
FIG. 6 is a time chart of signals, voltages, and currents in another modification of the second embodiment.

FIG. 6 illustrates a second modification of the second embodiment. In the second modification of the second embodiment, in addition to the other above-described conditions for the second embodiment, another condition may be that the current flowing through the coil 3 has not risen to a predetermined third upper limit value Itu3 even after the predetermined amount of time Ta or a longer duration of time has elapsed. The control circuit 205 (i.e., the determiner 205) may be used to detect whether the current flowing through the coil 3 has risen to a predetermined third upper limit value Itu3. As shown in FIG. 6, the third upper limit value Itu3 is set as a value between the first upper limit value Itu1 and the first lower limit value Itd1. However, the third upper limit value Itu3 may be set to the same value as the first upper limit value Itu1, may be set to the same value as the first lower limit value Itd1, or may be set to a value lower than the first lower limit value Itd1.

The control circuit 205 may instruct the discharge switch 6 to turn ON and apply the boosted voltage Vboost, for example, at time t4*c* in FIG. 6, upon determining that the voltage Via is lower than the threshold voltage Vt, and that the current flowing through the coil 3 has not risen to the third upper limit value Itu3 after an amount of time equal to the first predetermined time Ta or more has elapsed.

In other words, to determine whether to apply the boosted voltage Vboost to the coil 3, the control circuit 205 sets one condition where the voltage V a as detected by the comparator 19 is lower than the threshold voltage Vt, and sets another condition where the current flowing through the coil 3 has not risen to the third upper limit value Itu3. The use of multiple conditions to determine whether to apply the boosted voltage Vboost may provide a more reliable control process. The second modification of the second embodiment can achieve the same effects as the second embodiment, but with a more reliable control process.

Third Embodiment

Figure 7:
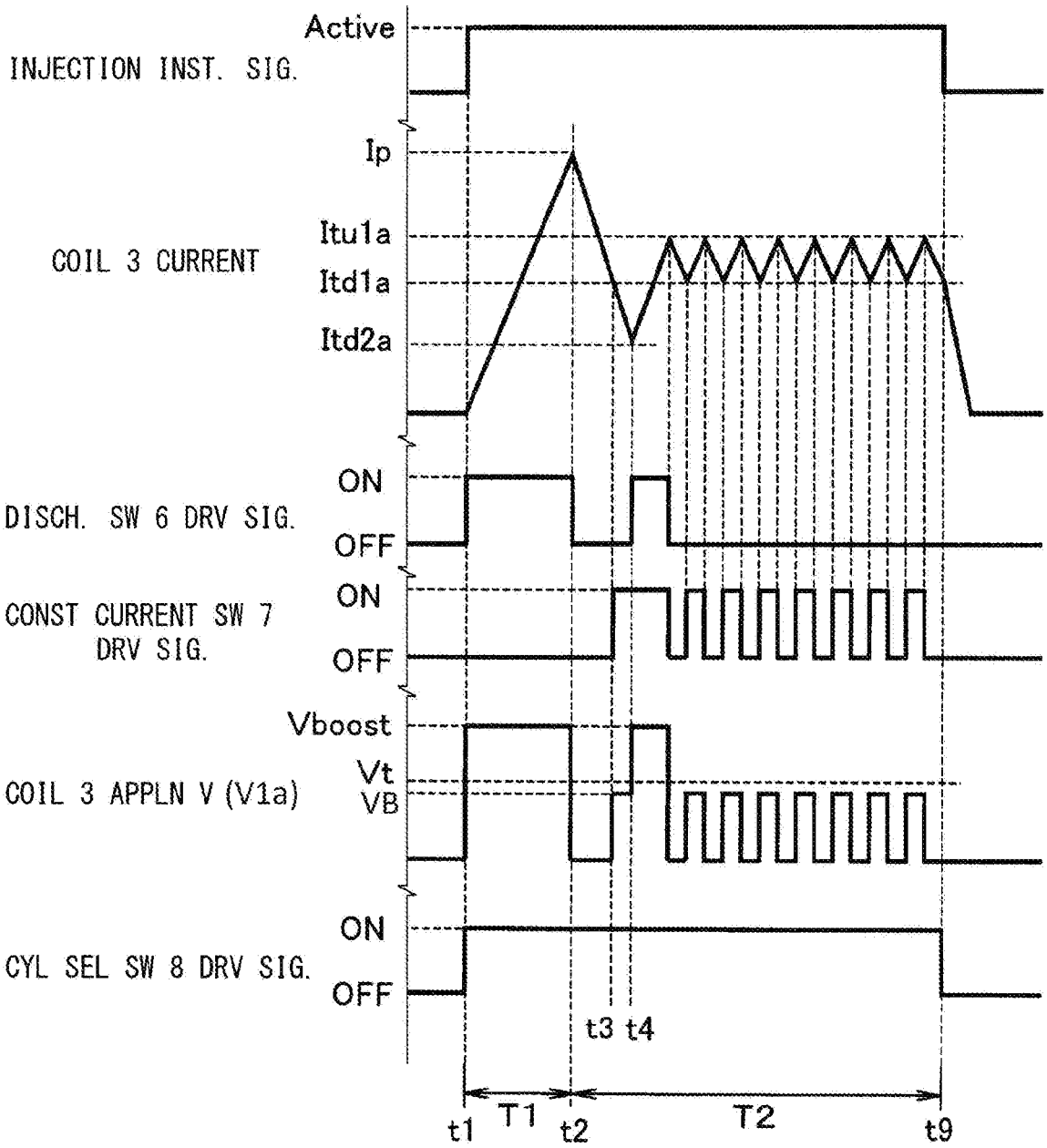
FIG. 7 is a time chart of signals, voltages, and currents in a modification of a third embodiment of the present disclosure.

FIG. 7 illustrates the third embodiment. The electronic control unit 101 shown in FIG. 1 may be used as the electronic control unit in the third embodiment. That is, like elements used in the third embodiment may use the same reference characters as the elements in the first embodiment. In the present embodiment, after the current of the coil 3 reaches the peak current threshold value Ip, the control circuit 5 performs the constant current control only once in a period T2 from time t2 to time t9. In other words, in view of the first embodiment, the control circuit 5 in the present embodiment operates in a mode in which the constant current control is not performed a second time, e.g., the hold current control is not performed.

FIG. 7 shows, as a timing chart, with events similar to the first embodiment occurring at times t1, t2, t3, t4, and t9. The first upper limit value and the first lower limit value of the constant current control range are respectively designated as Itu1*a* and Itd1*a*. The control circuit 5 applies the boosted voltage Vboost to the coil 3 when the voltage Via of the terminal 1*a* is lower than the threshold voltage Vt at time t4. The third embodiment can achieve the same effects as those achieved by the first embodiment.

Either a portion of, or the entirety of the pick-up current control period T2 between time t2 and time t9 in FIG. 7 can be set as a second predetermined time. The boosted voltage Vboost may be applied for the duration of the second predetermined time, or the boosted voltage Vboost may be applied a predetermined number of times in the pick-up current control period T2.

Fourth Embodiment

Figure 8:
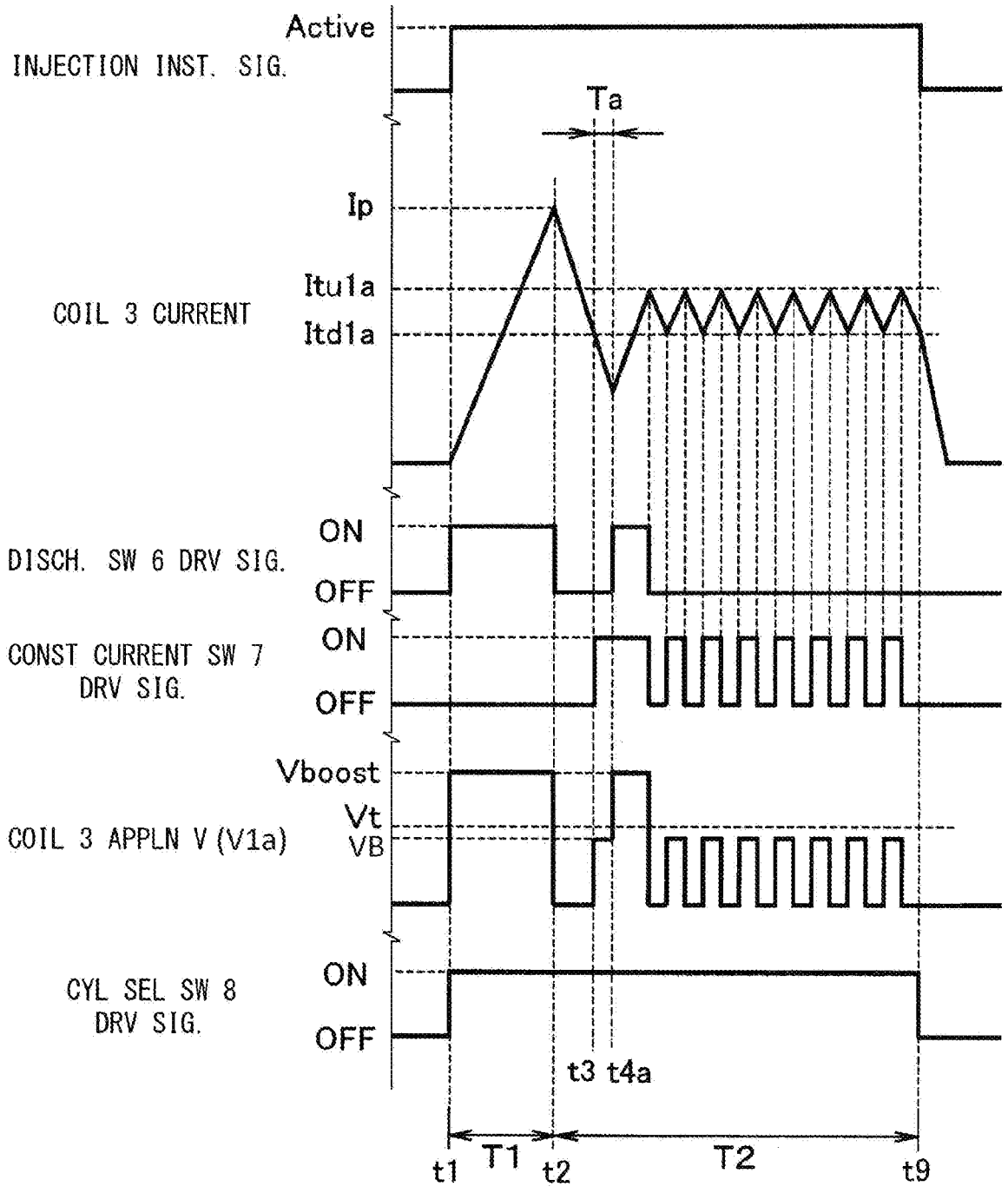
FIG. 8 is a time chart of signals, voltages, and currents in a modification of a fourth embodiment of the present disclosure.

FIG. 8 illustrates the fourth embodiment. The electronic control unit 201 shown in FIG. 3 may be used as the electronic control unit in the fourth embodiment. Like elements used fourth embodiment may use the same reference characters as the elements in the second embodiment. The present embodiment may also perform the constant current control only once during the period T2 between time t2 and time t9 after the current of the coil 3 reaches the peak current threshold value Ip. In other words, unlike the second embodiment, the constant current control in the present embodiment is not performed a second time, e.g., the hold current control is not performed.

FIG. 8 shows a timing chart similar to the second embodiment, with similar events occurring at times t1, t2, t3, t4*a*, and t9. The first upper limit value and the first lower limit value of the constant current control range are respectively designated as Itu1*a* and Itd1*a*. The control circuit 205 is configured to apply the boosted voltage Vboost after the predetermined amount of time Ta starting at time t3 has lapsed. After time t4*a*, that is, after the amount of time Ta has lapsed, the control circuit determines that the voltage Via at the terminal 1*a* is lower than the threshold voltage Vt.

The fourth embodiment can achieve the same effects as those achieved by the second embodiment.

Fifth Embodiment

Figure 9:
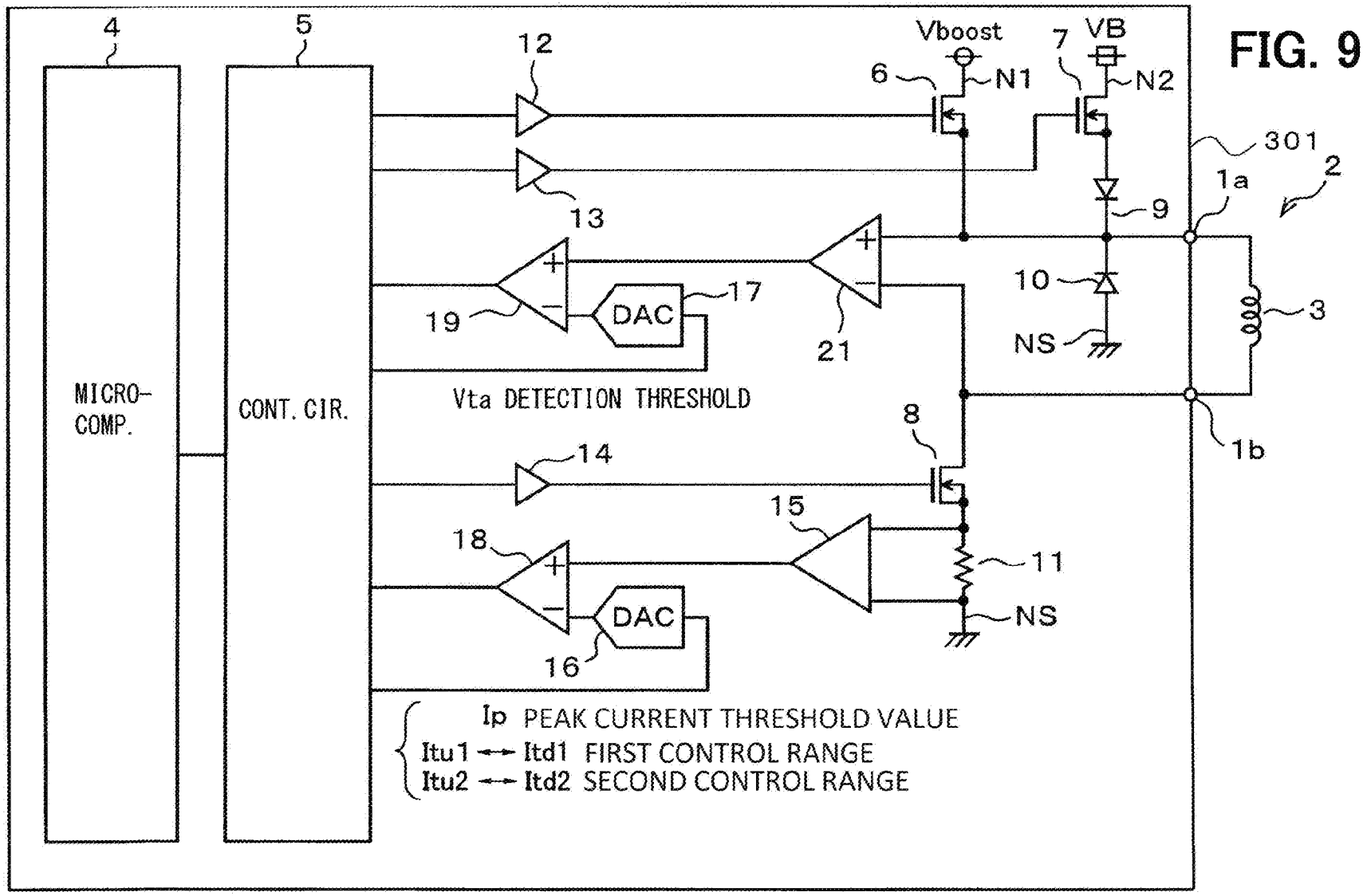
FIG. 9 illustrates a schematic diagram of the injection controller in a fifth embodiment of the present disclosure.

FIG. 9 illustrates the fifth embodiment. In the present embodiment, a differential voltage between the two terminals 1*a* and 1*b* of the coil 3 is defined as the application voltage of the coil 3, and the application voltage of the coil 3 is detected regardless of whether the differential voltage is lower than the threshold voltage Vt.

Like elements used in an electronic control unit 301 of the fifth embodiment may use the same reference characters as the like elements used in the electronic control unit 101 of the first embodiment. The following description focuses on the differences between the fifth embodiment and the previous embodiments.

FIG. 9 shows the configuration of the electronic control unit 301. The electronic control unit 301 has a similar configuration to the electronic control unit 101, but includes a differential amplifier 21. The voltage of the terminal 1*b* is input to the inverted input terminal of the differential amplifier 21, and the voltage of the terminal 1*a* is input to the non-inverted input terminal of the differential amplifier 21. The output of the differential amplifier 21 is input to the non-inverted input terminal of the comparator 19. Based on this configuration, the differential amplifier 21 calculates the differential voltage V1*a*-V1*b* between the voltage V1*a* of the terminal 1*a* and the voltage V1*b* of the terminal 1*b*, and outputs the differential voltage V1*a*-V1*b* to the comparator 19. The control circuit 5 inputs a predetermined voltage detection threshold value Vta via the D/A converter 17 to the inverted input terminal of the comparator 19. The comparator 19 can determine which of the differential voltage V1*a*-V1*b* and the predetermined threshold voltage Vta is higher, and can output the higher of the differential voltage V1*a*-V1*b* and the predetermined threshold voltage Vta to the control circuit 5. Thus, the application voltage applied to the coil 3 can be obtained by using the differential voltage.

For example, in the first embodiment where the comparator 19 is configured to compare the voltage Via of the terminal 1*a* and the predetermined threshold voltage Vt and output either a high level signal "H" or a low level signal "L," the voltage V a in the first embodiment is actually detected as a combination of (i) the application voltage to the coil 3, and (ii) a voltage that corresponds to the electric current supplied to the cylinder selection switch 8 and the current detection resistor 11. The combination, a sum of the two voltages is merely a rough estimation of the application voltage to the coil 3. That is, the voltage Via is not detected as the application voltage to the coil 3 itself.

In the configuration of the present embodiment, since the differential amplifier 20 detects the differential voltages V1*a*-V1*b*, the application voltage applied to the coil 3 can be more accurately detected and the control circuit 5 is enabled to set the threshold value voltage Vta based on the application voltage to the coil 3 via the D/A converter 17.

In the present embodiment, the configuration of the electronic control unit 301 is basically similar to the electronic control unit 101 of the first embodiment, but the electronic control unit 301 may be configured similar to the electronic control unit 201 in the second embodiment as well.

Other Embodiments

The present disclosure is not limited to the embodiments described above, and various modifications may further be implemented without departing from the spirit, scope, and gist of the present disclosure. For example, the present disclosure also contemplates the following modifications.

In the first to fourth embodiments, the voltage V1*a* of the terminal 1*a* may be considered as "a voltage corresponding to the application voltage of the coil." In the fifth embodiment, the differential voltage V1*a*-V1*b* between the voltage Via of the terminal 1*a* and the voltage V1*b* of the terminal 1*b* is considered as "a voltage according to the application voltage of the coil." However, depending on the circuit configuration in those embodiments and/or the addition of various passive/active circuit elements, other voltages applied to the coil 3 may also be used and considered as "the voltage according to the application voltage of the coil."

In the above description, the battery voltage VB is used as the "first voltage." However, a voltage generated by another circuit may be used as the "first voltage." In the above description, the boosted voltage Vboost is used as the "second voltage." However, a voltage generated by another circuit may also be used as the "second voltage." Any voltage may be used as the second voltage, as long as the second voltage is higher than the first voltage.

In the first and third embodiments, the boosted voltage Vboost is applied when the voltage V1*a* of the terminal 1*a* is lower than the predetermined threshold voltage Vt. In the second and fourth embodiments, the boosted voltage Vboost is applied when the predetermined amount of time Ta has lapsed after starting from time t3, and the voltage Vila for the duration of time Ta is lower than the predetermined threshold voltage Vt. However, the boosted voltage Vboost that is higher than the power supply voltage VB may be applied to the coil 3 when the voltage Via of the terminal 1*a* is lower than the predetermined threshold voltage Vt by using another detection means and determination unit.

Even though the circuit elements of the control circuit 5, the amplifier 15, the D/A converters 16 and 17, and the comparators 18 and 19 are integrated as one or more individual ASICs in the first embodiment, the present disclosure is not limited to such configuration, and these circuit elements may be provided as one or more integrated circuits or may be composed of discrete parts. The same applies to these circuit elements in the second, third, fourth, and fifth embodiments.

Various control devices may be used to replace the control circuits 5 and 205. Means and/or functions provided by the various control devices may be realized by the execution of software stored in the substantive storage medium by a computer or like processor as a software only implementation, by hardware elements as a hardware only implementation, or by a combination of software and hardware. For example, if the control device is provided by an electronic circuit, e.g., as hardware, the control device may be made up from a digital circuit or an analog circuit including one or more logic circuits. Further, for example, when the control device implements various controls by using software, a program is stored in a non-transitory, substantive storage medium, and a method corresponding to the program is performed by the control device that executes such a program.

In the above embodiments, the coil 3 is described as a device for driving the injection valve 2 in one cylinder for the ease of description/explanation. However, the above descriptions and configurations may be applied and performed regardless of the number of cylinders. For example, the number of cylinders may be 2, 4, and 6.

In the above-described embodiments, the discharge switch 6, the constant current switch 7, and the cylinder selection switch 8 are described as the MOS transistors. However, other types of transistors such as bipolar transistors and various types of switches may also be used.

Two or more embodiments described above may be combined to implement the control of the present disclosure. Likewise, parts of the above-described embodiments may be dispensed with and dropped as long as such modification to the injection controller still enables the injection controller to operate the injection valves reliably in low voltage supply conditions.

Although the present disclosure is described based on the above embodiments, the present disclosure is not limited to the above-described embodiments and the structures. The present disclosure is intended to cover various modification examples and equivalents thereof. In addition, various modes, one or more elements, and/or more complex and simpler configurations added to the above may also be considered as the present disclosure and understood as being within the technical scope of the present disclosure.

What is claimed is:

1. An injection controller comprising:

a voltage applicator configured to switch a first voltage on and off for an application of the first voltage to a driving coil to supply a less-than-peak current to an injection valve after the injection valve is opened by a second voltage with a peak current;

a low-voltage detector detecting whether a measured voltage measured at an upstream end of the driving coil falls to less than a threshold voltage; and a high-voltage applicator configured to apply the second voltage to the driving coil that is higher than the first voltage when the measured voltage falls to less than the threshold voltage.

2. The injection controller of claim 1, wherein the low-voltage detector is further configured to detect a differential voltage between two terminals of the driving coil as the measured voltage, and to determine whether the differential voltage is less than the threshold voltage.

3. The injection controller of claim 1 further comprising:

a control section configured to perform a pick-up current control and a hold current control, (a) the pick-up current control being a constant current control having an electric current within a first current control range between a first upper limit value and a first lower limit value, the first upper limit value and the first lower limit value lower than the peak current, and (b) the hold current control being a constant current control having an electric current within a second current control range between a second upper limit value that is set to be lower than the first upper limit value and a second lower limit value that is set to be lower than the first lower limit value, wherein the low-voltage detector is further configured to detect whether the measured voltage during the pick-up current control is less than the threshold voltage.

4. The injection controller of claim 1 further comprising:

a current detector configured to detect an electric current in the driving coil, wherein the high-voltage applicator is further configured to stop applying the second voltage when the electric current in the driving coil detected by the current detector reaches a first upper limit value that is lower than the peak current.

5. The injection controller of claim 1 further comprising:

a determiner configured to determine that the measured voltage falls to less than the threshold voltage when the measured voltage is less than the threshold voltage for at least a first predetermined amount of time.

6. The injection controller of claim 1 further comprising:

a determiner configured to determine that the measured voltage is less than the threshold voltage when the measured voltage is less than the threshold voltage for at least a first predetermined amount of time, and to determine a first lower limit current value, a second lower limit current value, and a third lower limit current value, wherein the high-voltage applicator is further configured to apply the second voltage when the determiner determines that (i) the measured voltage is less than the threshold voltage, and (ii) an electric current in the driving coil is less than or equal to the third lower limit current value.

7. The injection controller of claim 1 further comprising:

a determiner configured to determine that the measured voltage falls to less than the threshold voltage when the measured voltage is less than the threshold voltage for at least a first predetermined amount of time, and to determine a first upper limit current value, a second upper limit current value, and a third upper limit current value, wherein the high-voltage applicator applies the second voltage that is higher than the first voltage (i) when the determiner determines that the application voltage applied to the driving coil is lower than the threshold voltage, and (ii) when the determiner determines that the electric current in the driving coil has not yet reached a predetermined third upper limit value after the first predetermined amount of time has lapsed.

8. The injection controller of claim 1, wherein the high-voltage applicator is further configured to apply the second voltage only once each time the injection valve is opened.

9. The injection controller of claim 1, wherein the measured voltage with the peak current is generated by boosting a battery voltage, and the high-voltage applicator applies the boosted voltage as the second voltage.

10. The injection controller of claim 1, wherein the voltage applicator is a constant current control switch, and the high-voltage applicator is a discharge switch.

11. The injection controller of claim 1, wherein the voltage applicator continues to apply the first voltage as the high-voltage applicator applies the second voltage.

12. A control system comprising:

a processor; and a computer-readable storage medium including instructions that, when executed, cause the following:

turn ON a selection switch connected to a downstream side terminal;

turn ON a discharge switch connecting a boosted voltage to an upstream side terminal to generate an applied voltage across the terminals, such that the applied voltage equals the boosted voltage;

measure a current from a downstream side terminal;

upon a determination that the current is greater than or equal to a peak threshold current, turn OFF the discharge switch;

wherein a first control range ranges from a first lower limit to a first higher limit;

upon a determination that the current falls to less than or equal to the first lower limit, turn ON a constant current switch connecting a power supply voltage to the upstream side terminal;

upon a determination that the applied voltage falls to less than a threshold voltage, turn ON the discharge switch connecting the boosted voltage to the upstream side terminal;

upon a determination that the current is greater than or equal to the first higher limit, turn OFF the discharge switch and turn OFF the constant current switch.

* * * * *